US008259024B2

(12) United States Patent
Abe

(10) Patent No.: US 8,259,024 B2
(45) Date of Patent: Sep. 4, 2012

(54) RADIO WAVE RECEIVER WITH AN ANTENNA STRUCTURE

(75) Inventor: Kazuaki Abe, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 477 days.

(21) Appl. No.: 12/544,255

(22) Filed: Aug. 20, 2009

(65) Prior Publication Data

US 2010/0060540 A1 Mar. 11, 2010

(30) Foreign Application Priority Data

Sep. 9, 2008 (JP) ..... 2008-230697

(51) Int. Cl.
*H01Q 7/08* (2006.01)

(52) U.S. Cl. ..... 343/788; 343/718; 343/787; 368/47

(58) Field of Classification Search ..... 343/718, 343/787, 788; 368/47
See application file for complete search history.

(56) References Cited

U.S. PATENT DOCUMENTS

| | | | | |
|---|---|---|---|---|
| 4,947,179 | A * | 8/1990 | Ganter et al. | 343/718 |
| 5,768,217 | A * | 6/1998 | Sonoda et al. | 368/10 |
| 5,798,984 | A * | 8/1998 | Koch | 368/10 |
| 7,433,273 | B2 | 10/2008 | Oguchi et al. | |
| 7,436,372 | B2 | 10/2008 | Abe | |
| 7,515,112 | B2 * | 4/2009 | Someya et al. | 343/788 |
| 7,701,806 | B2 | 4/2010 | Oguchi et al. | |
| 8,040,287 | B2 * | 10/2011 | Kimura | 343/787 |

FOREIGN PATENT DOCUMENTS

| | | | |
|---|---|---|---|
| JP | 2004-257787 | A | 9/2004 |
| JP | 2004-274609 | A | 9/2004 |
| JP | 2004-354365 | A | 12/2004 |
| JP | 2005-175979 | A | 6/2005 |
| JP | 2006-115186 | A | 4/2006 |
| JP | 2007-166001 | A | 6/2007 |
| JP | 2007-170991 | A | 7/2007 |
| JP | 2007-184894 | A | 7/2007 |
| JP | 2008-082989 | A | 4/2008 |

OTHER PUBLICATIONS

Japanese Office Action dated Dec. 14, 2010 (and English translation thereof) in counterpart Japanese Application No. 2008-230697.

Japanese Office Action dated Jun. 29, 2010 and English translation thereof, issued in counterpart Japanese Application No. 2008-230697.

* cited by examiner

*Primary Examiner* — Tho G Phan
(74) *Attorney, Agent, or Firm* — Holtz, Holtz, Goodman & Chick, PC

(57) ABSTRACT

A radio wave receiver comprising an antenna structure placed within a case. The antenna structure has a rod-like core around which a coil is wound. A pair of opposite external magnetic members are each provided in a respective one of a pair of cavities provided so as to extend along the inner periphery of the case from adjacent the respective ends of the rod-like core toward the end points of an inner diameter of the case parallel to the axis of the rod-like core. The pair of external magnetic members is substantially the same permeability as the core. Thus, the antenna core is magnetically coupled to the pair of external magnetic members.

14 Claims, 9 Drawing Sheets

RADIO WAVE RECEIVER WITH AN ANTENNA STRUCTURE

CROSS-REFERENCE TO RELATED APPLICATION

This application is based upon and claims the benefit of priority from the prior Japanese Patent Application No. 2008-230697, filed Sep. 9, 2008, the entire contents of which are incorporated herein by reference.

BACKGROUND OF THE INVENTION

1. Field of the Invention

The present invention relates to radio wave receivers with an antenna structure.

2. Background Art

Radio-controlled watches are known which receive the standard waves including time information and set the current time thereof automatically. In these watches, many of the antenna structures which receive the standard waves include a core of magnetic material such as amorphous alloy or ferrite excellent in reception sensitivity and a coil wound around the core.

The reception sensitivity of the antenna structure increases as the core is longer and its radio wave reception area increases. However, since a small electronic device such as a radio-controlled wristwatch has a limited inner space, the antenna structure to be incorporated in the space is required to be small in size.

JP 2007-184894 discloses a radio-controlled wristwatch in which a pair of amorphous films are each disposed at a respective one of ends of a rod-like core provided within a metal case so as to be magnetically coupled to the core to improve the reception sensitivity thereof even when the antenna structure is made small.

When the radio wave receiver is a wristwatch, its case is often made of a metal material such as titanium or stainless steel from the standpoint of designability and a sense of high quality.

When the antenna structure is received within the metal case, a flow of radio waves or magnetic flux is intercepted by the case and eddy currents will be produced in the case, thereby producing no sufficient reception sensitivity.

JP 2007-170991 discloses the use of a magnetic member of low conductivity and high permeability fitted into a cavity provided within a metal case along the antenna structure in order to prevent production of eddy currents in the case, thereby preventing a reduction in the reception sensitivity.

With the invention of JP 2007-184894, the pair of magnetic members of high permeability and low conductivity disposed in the case serve to reduce eddy currents occurring in the metal case, but cannot improve the reception sensitivity. Thus, when the antenna structure is made small in size, it cannot ensure satisfactory reception sensitivity.

It is therefore an object of the present invention to provide reduced-sized antenna structure which captures the magnetic flux of the radio waves efficiently and improves the reception sensitivity, and a reduced-sized radio wave receiver including the antenna structure therein.

SUMMARY OF THE INVENTION

In order to achieve the above object, the present invention provides a radio wave receiver comprising an antenna structure including a rod-like core of a magnetic material and a coil wound around the core. A case is provided to encase the antenna structure therein. A pair of external magnetic members each made of a magnetic material of a permeability similar to that of the core is received in a respective one of a pair of cavities provided within the case adjacent to a respective end of the core such that the core is magnetically coupled to the respective external magnetic members.

According to one aspect of this invention, the pair of external magnetic members are magnetically coupled to the respective ends of the core. Thus, even when the antenna structure is small and has a short core, a sufficient area for radio wave reception is ensured, thereby improving the reception sensitivity of the radio wave receiver.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

First Embodiment

Figure 1:
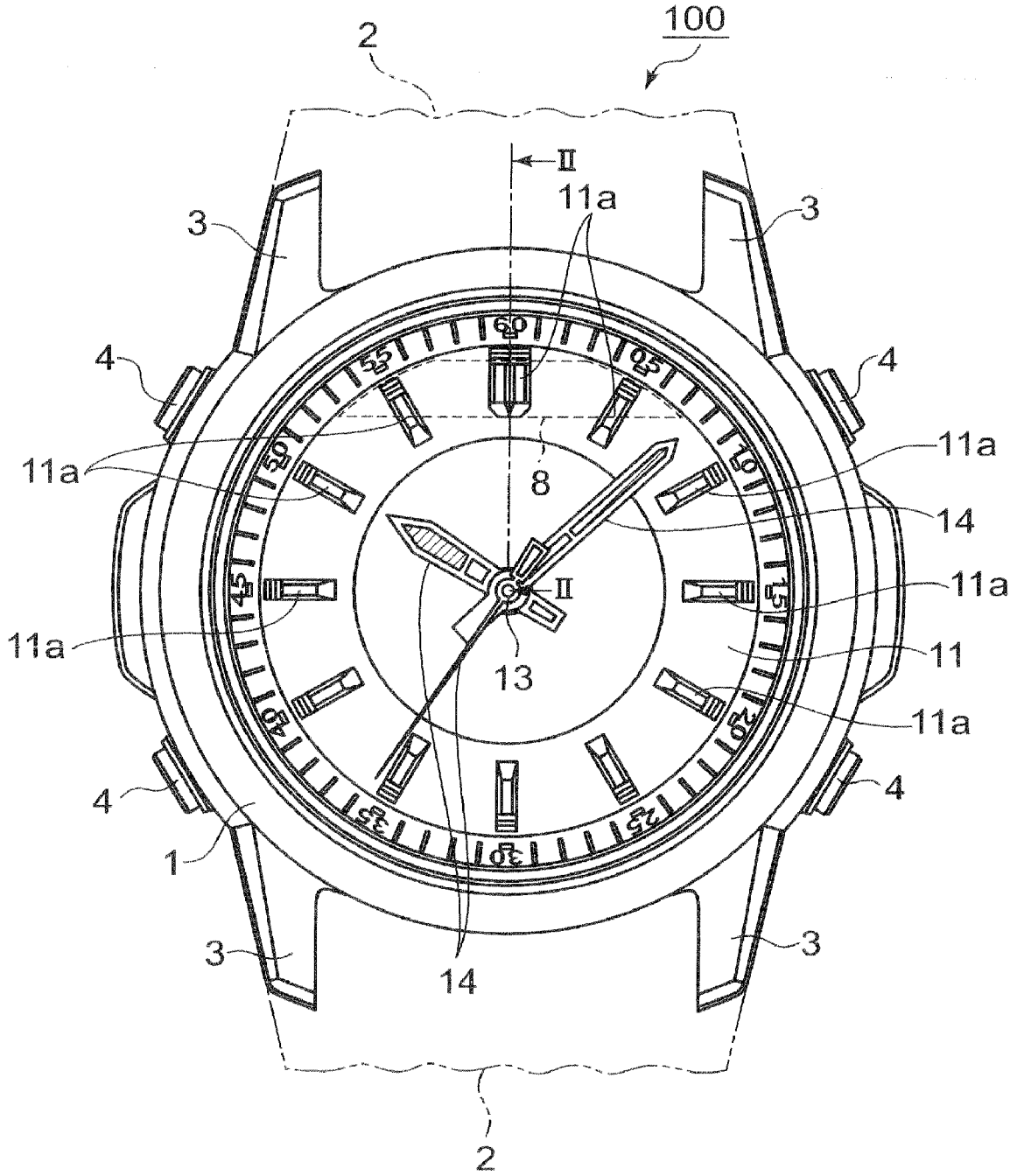
FIG. 1 is a front view of one preferred embodiment of a radio wave receiver according to the present invention in the form of a radio-controlled wristwatch.
Figure 2:
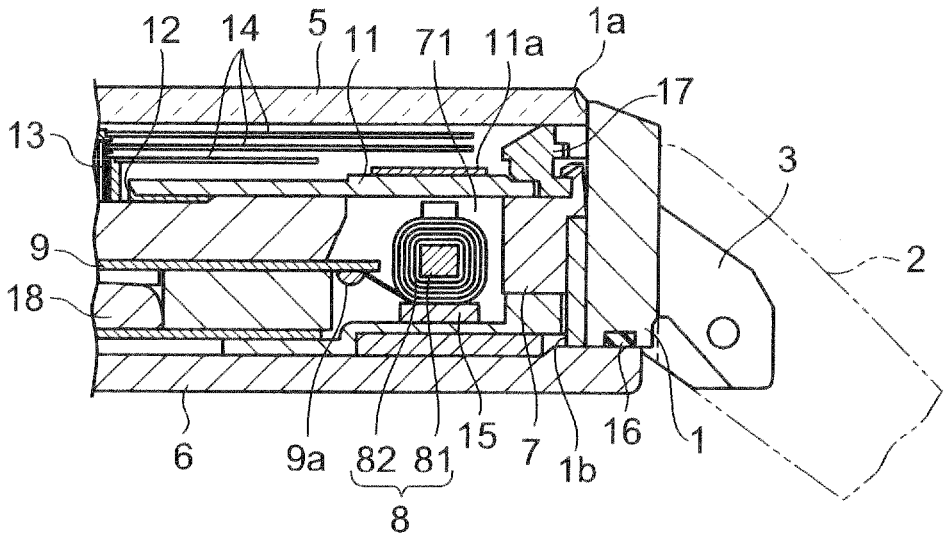
FIG. 2 is a cross-sectional view taken along a line II-II of FIG. 1.

Referring to FIGS. 1-6, a radio wave receiver 10 and a radio-controlled wristwatch including the radio receiver, as a first embodiment of the present invention, will be described. FIG. 1 is a schematic front view of the wristwatch. FIG. 2 is a cross-sectional view taken along a line II-II in FIG. 1.

As shown in FIG. 2, the wristwatch 100 has a ring-like case 1 made of an electrical insulator such as ceramic. The material of the case 1 is only required to be an electrical insulator, and especially not limited to ceramic. However, preferably, fine ceramic is used which has metallic gloss thereon from the standpoint of design. When a material with no metallic gloss thereon is used for the case; it is preferably processed so as to have the metallic gloss thereon.

The case 1 has wristband rug pairs 3 provided at 6 and 12 o'clock positions thereof and to which the wristband 2 is attached at its ends. A plurality of operation buttons 4 are provided along the outer periphery of the case 1 to give several instructions including, for example, one for time setting.

A non-conductive glass cover 5 is attached to an upper end 1*a* of the ring-like case 1 and a back cover 6 is attached to the lower end 1*b* of the case 1 through a waterproof ring 16. The back cover 6 may be made of the same ceramic as the case 1 or otherwise may be made of a metal.

Provided within the case 1 is a housing 7 of a material or resin through which radio waves are allowed to pass. Provided within the housing 7 is a circuit board including a printed wiring board 9 on which various electronic parts (not shown) are disposed.

One of the electronic parts is a time counter (not shown) which performs various functions. The time counter includes a CPU (Central Processing Unit), a RAM (Random Accesses Memory), a ROM (Read Only Memory) and various other circuit sections (not shown).

As shown in FIG. 2, a battery 18 is provided within the housing 7 to act as a power source which causes the wristwatch 100 to perform various operations.

The housing 7 has a space 71, which accommodates the antenna structure 8, provided near a 12 o'clock position (FIG. 1) on the wristwatch 100 when the housing 7 is placed within the case 1. The space 71 extends parallel to a line connecting 3 and 9 o'clock positions on the wristwatch.

The antenna structure 8 is encased within a radio-wave transparent case 83 (FIG. 3) and supported along with the case 83 on a base 15 within the space 71. The base 15 is made of an elastic adhesive to prevent unsteadiness of the antenna structure 8 and to absorb shocks which may be given to the antenna structure 8.

A panel cover 17, for example, of a non-conductive resin is provided along the inner periphery of the case 1 between the housing 7 and the glass cover 5. A dial 11 is placed below the glass cover 5 (in FIG. 2) within the case 1 so as to be supported at its periphery between the housing 7 and the panel cover 17. As shown in FIG. 1, hour letters 11*a* are marked respectively at 1-12 o'clock positions on the dial 11 of the wristwatch along the periphery of the dial 11.

A hand shaft 13 extends through a center hole 12 in the dial 11 and has hour, minute and seconds hands 14 attached thereto between the glass cover 5 and the dial 11 so as to be rotated by the time counter.

The antenna structure 8 includes a rod-like core 81 and a coil 82 wound around the core 81. When radio waves pass through the core 81, an electric current is induced so as to flow through the coil 82. The coil 82 is connected at its ends to terminals 9*a* on the circuit board 9.

The core 81 is made of a plurality of thin layers of low conductivity and of high permeability μ or high specific permeability μs (=μ/μ0 where μ0 is the permeability of vacuum). Each layer is made of a 20 μm or less thick soft-magnetic metal foil of amorphous alloy, magnetic nanocrystalline alloy of an Fe—Cu—Nb—Si—B system, or magnetic alloy of Fe—Si system.

Alternatively, permalloy (Fe—Ni alloy of high permeability) may be used as the material of the core 81, which effectively catches the magnetic flux and improves the reception sensitivity of the antenna structure 8. The core 81 is flexibly bendable and deformable to some extent.

Figure 3:
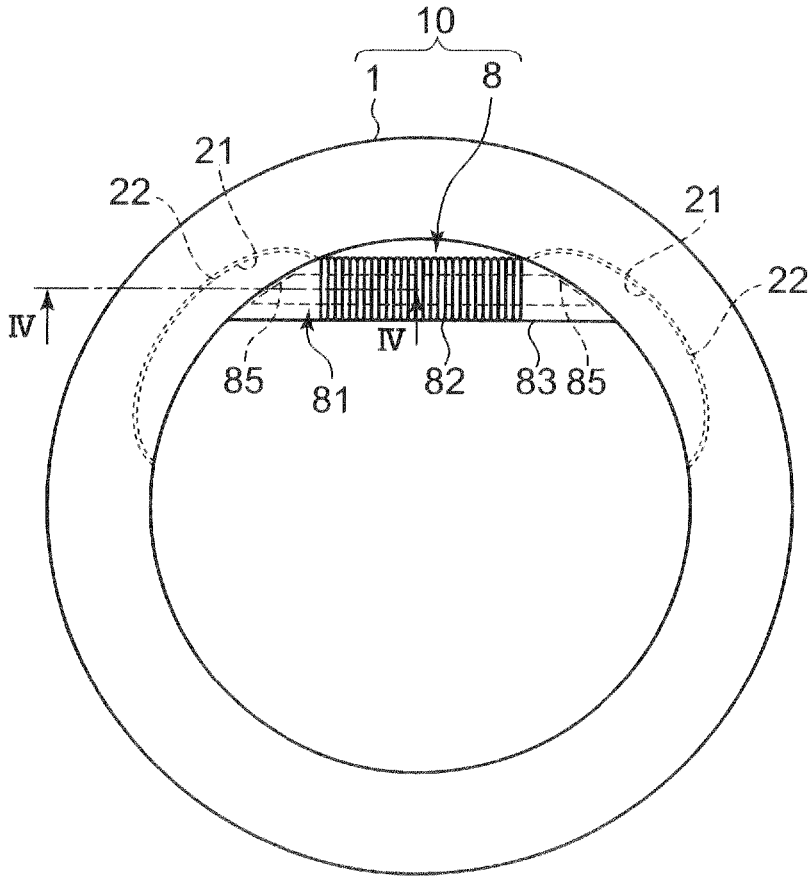
FIG. 3 is a front view of an essential portion of the wristwatch of the first embodiment in which the antenna structure is received within the case.

As shown in FIG. 3, when the antenna structure 8 is placed in position within the case 1, a pair of opposite external arcuate magnetic members 22 of the same material as the core 81 are each embedded in a respective one of a pair of cavities 21 provided within the case 1 each adjacent to a respective end 85 of the core 81 within the case 1.

If the core 81 is made, for example, of amorphous alloy, the external magnetic members 22 are also made of amorphous alloy. If the core 81 is made of permalloy, the external magnetic members 22 are also made of film layers of permalloy.

That is, by forming the external members 22 with the same material as the core 81, the magnetic flux can be collected more efficiently than otherwise. So long as the external magnetic members 22 are made of a magnetic material, however, they are not necessarily required to be the same material as the core 81.

Figure 4:
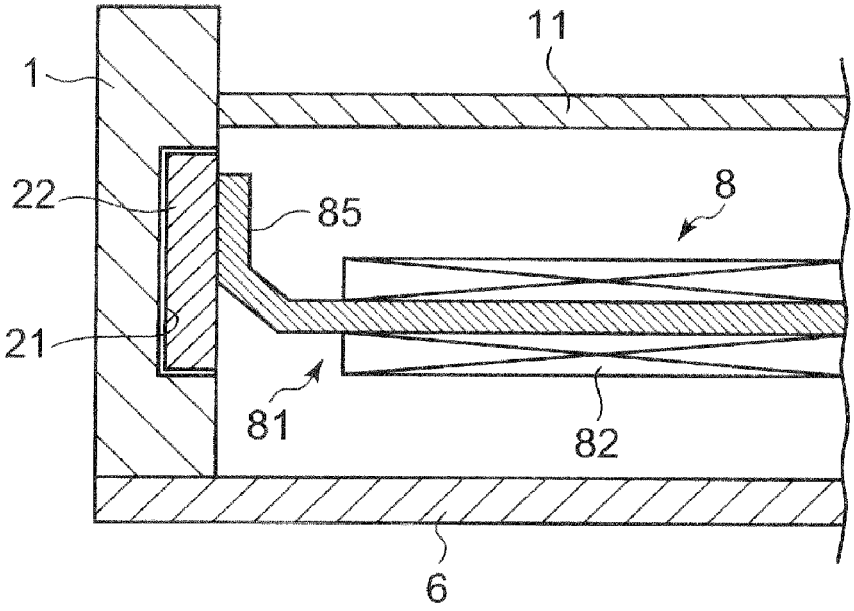
FIG. 4 is a cross-sectional view taken along a line IV-IV of FIG. 3.

FIG. 4 is a cross-sectional view taken along a line IV-IV in FIG. 3, illustrating attaching relationship between the antenna structure 8 and the case 1. In this embodiment, when the antenna structure 8 is placed within the case 1 from above, the core 81 is bent in an L-like shape at each end 85 (or in the form of U as a whole) by the inner surface of the case 1, as shown in FIG. 4. The core 81 is then brought into contact at its ends with the respective external magnetic members 22 in a magnetically coupled manner within the case 1.

The radio wave receiver 10 includes the antenna structure 8 and the case 1 containing the pair of opposite external magnetic members 22.

Figure 5:
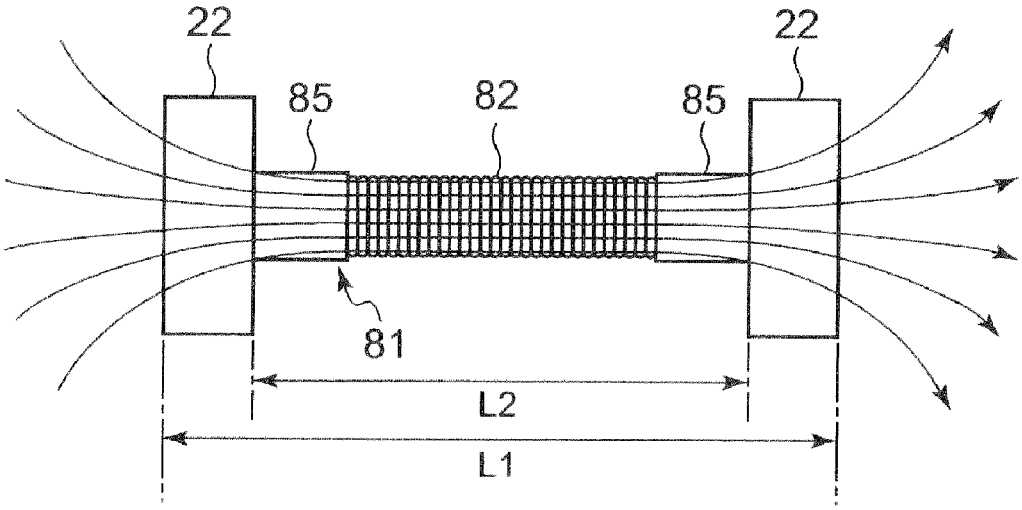
FIG. 5 illustrates a flow of magnetic flux flowing into a core of the antenna structure in the first embodiment of the present invention.

FIG. 5 schematically illustrates a flow of magnetic flux entering the core 81 of the antenna structure 8.

As shown in FIG. 5, the core 81 is connected at each end 85 to the corresponding external magnetic member 22.

Thus, the length L2 of the core 81 is the sum of the original length L2 of the core 81 and both the thicknesses of the external magnetic members 22. The reception sensitivity is increased. In addition, the external magnetic members 22 have a wider surface area than the core 81. Thus, the antenna structure of FIG. 5 can collect magnetic flux more efficiently than an antenna structure having a length L1 greater than and a same thickness as the original core 81.

Figure 6:
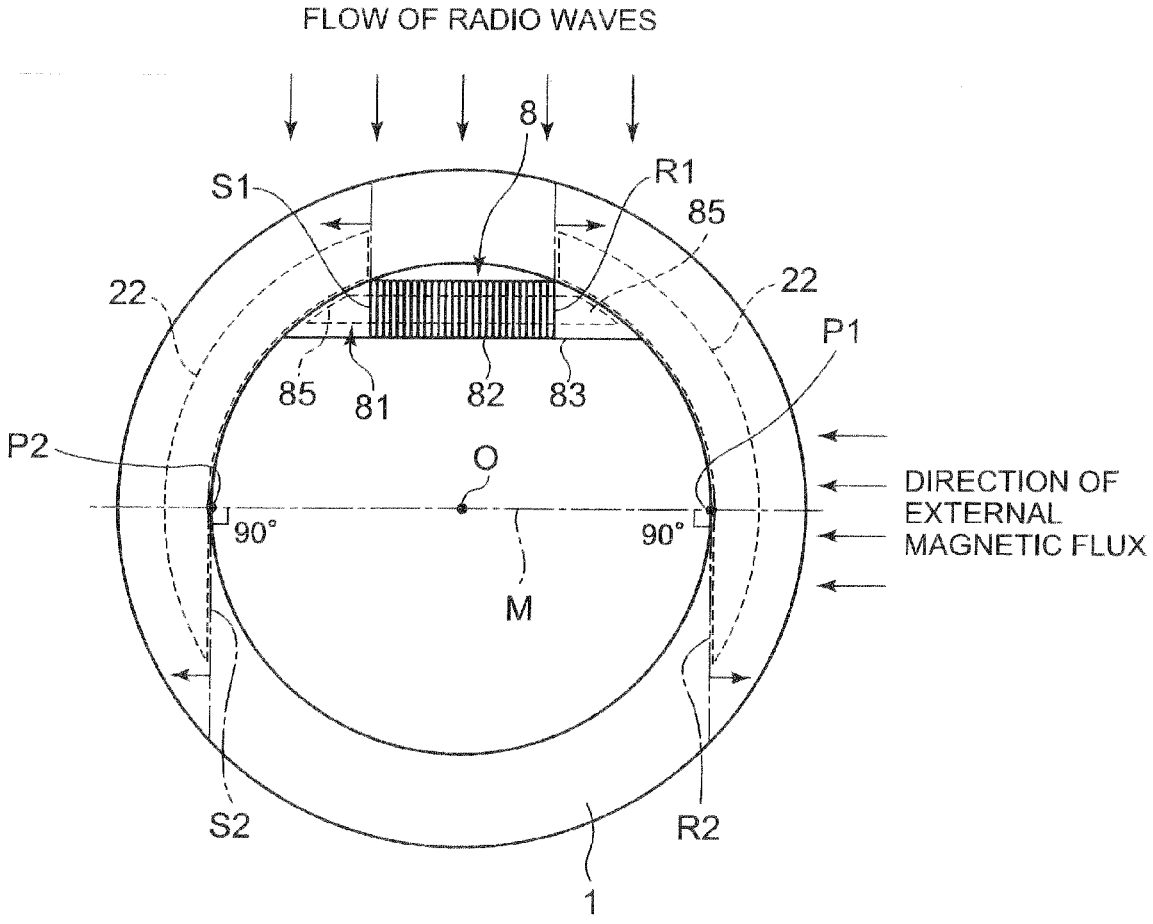
FIG. 6 illustrates the position of a pair of external magnetic members provided within the case.

FIG. 6 illustrates a pair of opposite positions within the case 1 where the pair of external magnetic members 22 are provided, respectively. It is assumed in FIG. 6 that the external magnetic field flows in the extending direction of the antenna structure 8 and that radio waves flow in a direction orthogonal to the flow of the external magnetic field.

When the size of the external magnetic members 22 increases, the magnetic flux can be more easily collected. However, if the pair of opposite external magnetic members 22 each extend from near a respective end of the coil 82 along the inner periphery of the case 1 beyond a limit, the magnetic flux cannot be guided efficiently and the reception sensitivity will be reduced. In order to avoid this undesirable situation, the pair of external magnetic members 22 are each required to be disposed at a position where the magnetic flux flows into the coil 82 in a shortest route.

More specifically, it is assumed that the case 1 has an inner circular periphery. As shown in FIG. 6, the pair of opposite external magnetic members 22 preferably are each disposed in a respective one of the pair of cavities 21 outward of each end R1, S1 of the antenna coil 82 so as to be able to extend away from near the respective end of the core 81 beyond a first line M parallel to the axis of the core 81 and passing through the center O of the inner circular periphery of the case 1, but fail to further extend beyond a respective one of two second lines R2, S2 orthogonal to the first line N and each passing through two points P1, P2, respectively, on the inner circular periphery of the case 1 where the first line M intersects the case 1.

As long as the external magnetic members 22 are within this limited range, their size and shape are especially not limited.

Briefly, the radio wave receiver 10 of this embodiment will be fabricated as follows: The pair of opposite external arcuate magnetic members 22 are each embedded in position within the respective one of the pair of cavities 21 provided on the inner periphery of the ceramic case 1. Then, the antenna structure 8 is placed within the housing 7 such that the core 81 of the antenna structure 8 is bent at ends 85 thereof along the inner surfaces of the case 1 and then brought into contact with the external magnetic members 22 so as to be magnetically coupled to the same.

In operation, in the reception of the standard waves by the radio wave receiver 10, the magnetic field components of the waves enter the core 81 of the antenna structure 8 through the non-conductive glass cover 5 and dial 11 which do not shield the core 81 from the waves. The magnetic flux is collected by the external magnetic members 22 embedded within the case 1 and then enters the antenna structure 8 at one end 85 of the core 81 magnetically coupled to the external magnetic members 22.

The magnetic flux then passes to the other end 85 of the core 81. At this time, an AC current is induced through the coil 82 wound around the core 81, thereby generating a corresponding AC voltage across the coil 82, which is then sent as an analog signal to a reception circuit (not shown).

The reception circuit (not shown) amplifies, demodulates and decodes the received signal, thereby acquiring corresponding digital time data. The wristwatch 100 adjusts the current time as required based on the acquired time data.

As described above, according to this embodiment of the wristwatch 100, the ends 85 of the core 81 are connected to the respective corresponding external magnetic members 22, thereby increasing the length of the core 81 and its surface area substantially.

Thus, even when the length of the core 81 is short compared to the prior art one, as shown in FIG. 5B, the magnetic flux can be collected efficiently, thereby generating enough electromotive force across the coil 82. Thus, the antenna structure 8, the radio wave receiver 10 including the antenna structure 8, and the wristwatch 100 including the receiver 10 are reduced in size, and increased greatly in reception sensitivity.

In the particular embodiment, the case 1 is made of the electrically insulating material or ceramic. Thus, a decrease in the reception sensitivity of the antenna structure 8 is avoided compared to wristwatches which employ a metal case.

Second Embodiment

Figure 7:
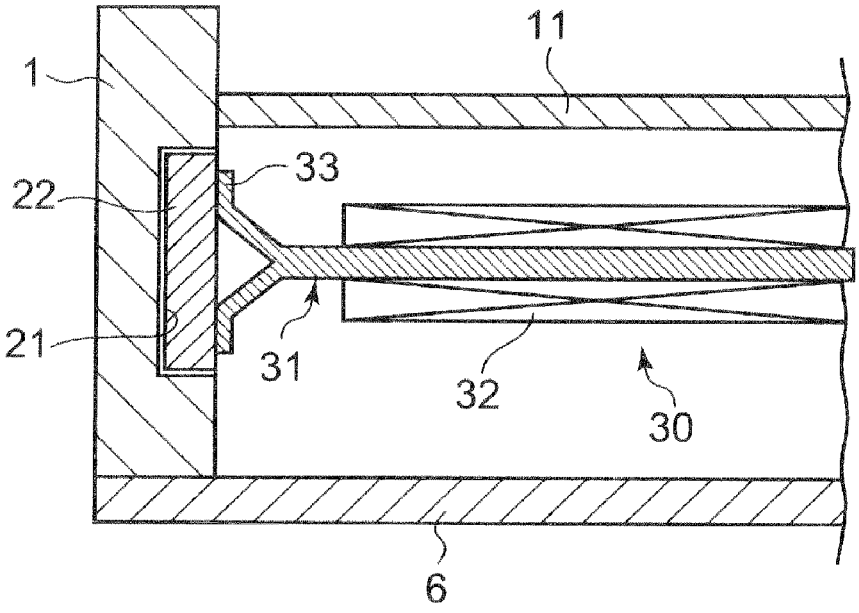
FIG. 7 is a cross-sectional view of an essential portion of a second embodiment, illustrating connecting relationship between the antenna structure and the case.

Referring to FIG. 7, the second embodiment of the radio wave receiver according to the present invention will be described. The second embodiment is different from the first embodiment with respect to the connecting structure of the antenna core end to the external magnetic member. Thus, especially, those respects of the second embodiment different from the first embodiment will be described below.

Like the first embodiment, the radio wave receiver of the second embodiment is in the form of a radio-controlled wristwatch including a ceramic case 1 and an antenna structure 30. FIG. 7 is a cross-sectional view of an essential portion of the wristwatch, illustrating the contacting relationship between the antenna structure 30 and the case 1.

In the present embodiment, the core 31 of the antenna structure 30 is made of a plurality of thin layers of amorphous alloy (not shown). Each end portion 33 of the core 31 is in the form of Y whose branches are connected at their ends (in an up and down direction in FIG. 7) to the corresponding external magnetic member 22.

A pair of opposite external arcuate magnetic members 22 are each embedded within a respective one of a pair of cavities 21 provided along the inner periphery of the case 1, as in the first embodiment.

When the antenna structure 30 is placed together with the housing 7 within the case 1, the core 31 is brought at its Y-shaped ends 33 into contact with the inner surface of the case 1 and then the respective external magnetic members 22 such that the core 31 is magnetically coupled to the external magnetic members 22, as shown in FIG. 7.

The second embodiment is in other respects similar in structure to the first embodiment. Thus, the same reference numerals are given to similar components and their further description will be omitted.

Briefly, the radio wave receiver 10 of this embodiment will be fabricated as follows: The pair of opposite external arcuate magnetic members 22 are each embedded in position within the respective one of the pair of cavities 21 provided along the inner periphery of the ceramic case 1.

Then, the antenna structure 30 is placed within the case 1 such that the antenna core 31 is flexibly deformed at its end portion 33 along the inner surface of the case 1 and then brought into contact with the inner surfaces of the external magnetic members 22 so as to be magnetically coupled to the same.

In operation, in the reception of the standard waves, the magnetic field components of the waves enter the core 31 of the antenna structure 30 through the glass cover (not shown) and dial (not shown). The magnetic flux is collected by the external magnetic members 22 embedded within the case 1 and then enters the antenna structure 30 at one end 33 of the core 31 magnetically coupled to the associated external magnetic members 22.

The magnetic flux entering the antenna structure 30 passes to the other end 33 of the core 31. At this time, an AC current is induced through the coil 32 wound around the core 31, thereby generating a corresponding AC voltage across the coil 32, which is then sent as an analog signal to a reception circuit (not shown).

The reception circuit amplifies, demodulates and decodes the received signal, thereby acquiring corresponding digital time data. The wristwatch adjusts the current time as required based on the acquired time data.

As described above, according to this embodiment of the wristwatch, the ends 33 of the core 31 are connected to the respective corresponding external magnetic members 22, thereby increasing the length of the core 31 and its surface area substantially. Thus, even when the length of the core 31 is reduced, the magnetic flux is collected efficiently, thereby generating enough electromotive force across the coil 32. Thus, the antenna structure 30, the radio wave receiver including the antenna structure, and the watch including the receiver are reduced in size, and increased greatly in reception sensitivity.

In the embodiment, the core 81 has the Y-shaped end portions 33. Thus, the core 31 is connected in a stabilized manner and in a widened area to the external magnetic members 22.

Third Embodiment

Figure 8:
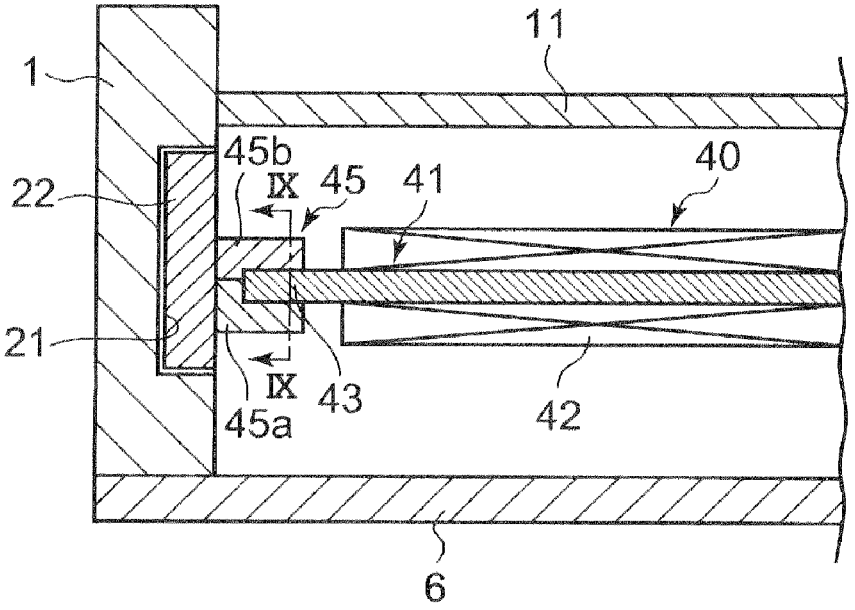
FIG. 8 is a view of a third embodiment similar to FIG. 7, using one of a pair of core supports which supports the core to the case.
Figure 9:
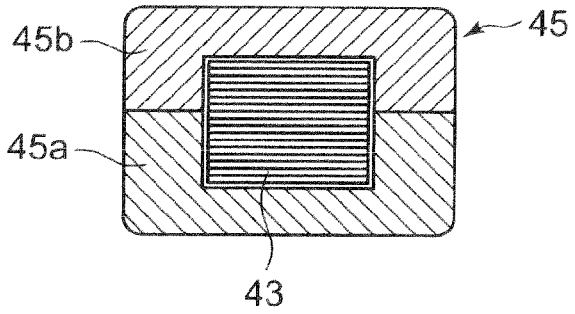
FIG. 9 is a cross-sectional view taken along a line IX-IX of FIG. 8.

Referring to FIGS. 8 and 9, the third embodiment of the radio wave receiver according to the present invention will be described. The third embodiment is different from the first and second embodiments with respect to the connecting structure of the antenna core end to the external magnetic members. Thus, especially, those respects of the third embodiment different from the first and second embodiments will be described below.

Like the first and second embodiments, the radio wave receiver of the third embodiment is in the form of a radio-controlled wristwatch including a ceramic case 1 and an antenna structure 40.

FIG. 8 is a cross-sectional view of an essential portion of the wristwatch, illustrating the contacting relationship between the antenna structure 40 and the case 1. In the present embodiment, the core 41 of the antenna structure 40 is made of a plurality of thin layers of amorphous alloy (not shown), as in the first and second embodiments.

A pair of opposite external arcuate magnetic members 22 are each embedded within a respective one of a pair of cavities 21 provided symmetrically along the inner periphery of the case 1, as in the first embodiment.

In this embodiment, the core 41 of the antenna structure 40 is supported at each end 43 by a core support 45 fixed to a corresponding external magnetic member 22. FIG. 9 is a cross-sectional view taken along a line IX-IX of FIG. 8. The core support 45 is made of a magnetic material such as, for example, ferrite although not limited to ferrite.

As shown in FIG. 9, the core support 45 includes a pair of upper and lower core subsupports 45*b* and 45*a* between which the corresponding end portion 43 of the core 41 is held. The lower core subsupport 45*a* is fixed to the corresponding external magnetic member 22, and the upper upper core subsupport 45*b* is removable.

When the antenna structure 40 is placed along with the housing within the case 1, the antenna core 41 is supported at each end 43 from below by the corresponding lower core subsupport 45*a*. Then, the upper core subsupport 45*b* is placed from above onto the corresponding core end 43 and then joined to the lower core subsupport 45*a*. Thus, the core 41 is brought at both ends 43 into contact with the inner surfaces of the pair of external magnetic members 22 within the case 1 through the respective core supports 45 so as to be magnetically coupled to the same.

The third embodiment is in other respects similar in structure to the first and second embodiments. Thus, the same reference numerals are given to similar components and their further description will be omitted.

Briefly, the radio wave receiver 10 of this embodiment will be fabricated as follows: The pair of external arcuate magnetic members 22 are each embedded in position within the respective one of the pair of cavities 21 provided along the inner periphery of the ceramic case 1. Then, both the lower core subsupports 45*a* are fixed in position so as to be in contact with the corresponding external magnetic members 22.

Then, the antenna structure 40 is placed within the case 1 such that the antenna core 41 is supported at both ends 43 by the corresponding lower core subsupports 45*a*. Then, the upper core subsupports 45*b* are placed onto the corresponding core ends 43 from above so as to be joined to the core subsupports 45*a*. Thus, the core 41 is brought into contact with the inner surfaces of the external magnetic members 22 through the pair of core subsupports 45 in a magnetically coupled manner.

In operation, in the reception of the standard waves, the magnetic field components of the waves enter the core 41 of the antenna structure 40 through the glass cover (not shown) and the dial 11. The magnetic flux is collected by the external magnetic members 22 embedded within the case 1 and then enters the antenna structure 40 at one end 43 of the core 41 magnetically coupled to the associated external magnetic members 22.

The magnetic flux entering the antenna structure 40 then passes to the other end 43 of the core 41. At this time, an AC current is induced through the coil 42 wound around the core 41, thereby generating an AC voltage across the coil 42, which is then sent as an analog signal to a reception circuit (not shown).

The reception circuit amplifies, demodulates and decodes the received signal, thereby acquiring corresponding digital time data. The wristwatch adjusts the current time as required based on the acquired time data.

As described above, according to this embodiment of the wristwatch, the ends 43 of the core 41 are connected to the respective corresponding external magnetic members 22, thereby increasing the length of the core 41 and its surface area substantially. Thus, even when the length of the core 41 is reduced, the magnetic flux is collected efficiently, thereby generating enough electromotive force across the coil 42. Thus, the antenna structure 40, the radio wave receiver including the antenna structure, and the wristwatch including the receiver are reduced in size, and increased greatly in reception sensitivity.

In the present embodiment, the core 41 is supported at each end by the corresponding core support 45 through which the core is connected to the corresponding external magnetic member 22. Thus, even when the core 41 has no sufficient flexibility at its ends and can not be brought into enough contact with the external magnetic members 22, the core 41 is connected to the pair of external magnetic members 22 in a stabilized manner.

While in the present embodiment the core support 45 is illustrated as being composed of the pair of core subsupports 45*a* and 45*b*, core supports to be used are not limited to the particular one.

Figure 10:
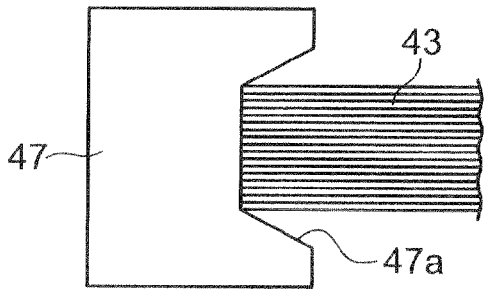
FIG. 10 is a side view of a modification of one of the pair of core supports of FIG. 8.

For example, as shown in FIG. 10, a single-piece core support 47 may be used instead which has an inward tapering recess 47*a* which receives a corresponding end of the core 43. In this case, each core end may have a shape complementary to the cross-sectional shape of the recess 47*a* in the single-piece core support 47.

In assembly, the antenna structure 40 with the core supports 45 or 47 attached to the respective ends thereof may be placed within the case 1. The shapes of the core support 45 and the core end 43 may be changed as required.

Fourth Embodiment

Figure 11:
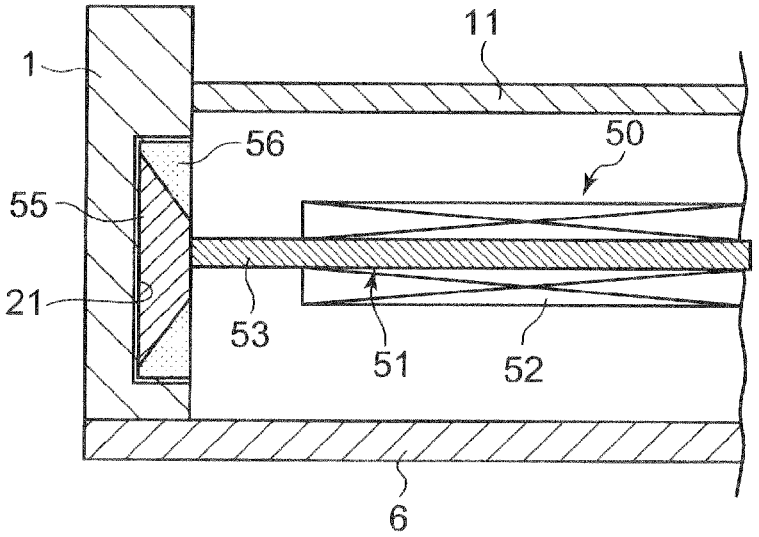
FIG. 11 is a view of a fourth embodiment similar to FIG. 8.
Figure 12:
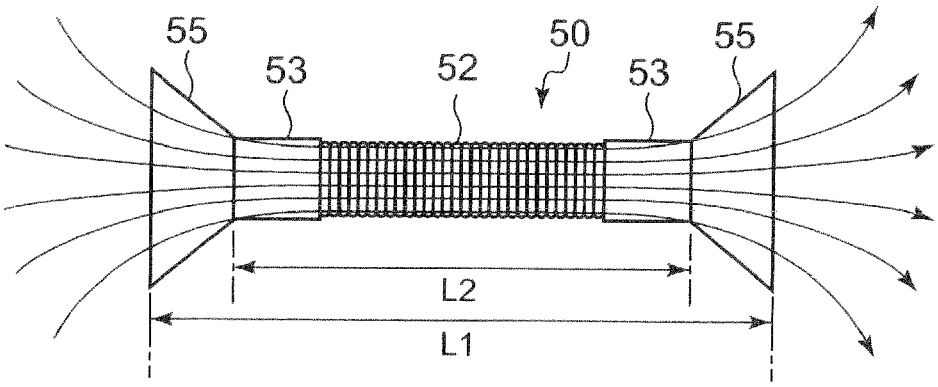
FIG. 12 illustrates magnetic flux flowing into the core of the antenna structure of FIG. 11.

Referring to FIGS. 11 and 12, the fourth embodiment of the radio wave receiver according to the present invention will be described. The fourth embodiment is different from the first-third embodiments with respect to the connecting structure of the antenna core end to the external magnetic members. Thus, especially, those respects of the fourth embodiment different from the first-third embodiments will be described below.

Like the first-third embodiments, the radio wave receiver of the fourth embodiment is in the form of a radio-controlled wristwatch including a ceramic case 1 and an antenna structure 50. FIG. 11 is a cross-sectional view of an essential portion of the wristwatch, illustrating the contacting relationship between the antenna structure 50 and the case 1.

In the present embodiment, the core 51 of the antenna structure 50 is made of a plurality of thin layers of amorphous alloy (not shown), as in the first-third embodiments.

A pair of opposite external arcuate magnetic members 55 are each embedded within a respective one of a pair of cavities 21 provided along the inner periphery of the case 1, as in the first embodiment.

In this embodiment, each external magnetic member 55 has a trapezoidal cross section divergent axially outward and is received within the corresponding cavity 21 provided in the case 1 to efficiently catch magnetic flux externally entering the core 51, thereby guiding the flux into the coil 52, as shown in FIG. 12.

A remaining space within each cavity 21 where the associated trapezoidal-sectional external magnetic member 55 is disposed is filled with a reinforced material, which may be a resin 56, to support the external magnetic member 55 fixedly.

When the antenna structure 50 is placed together with the housing within the case 1, the core 51 is brought sequentially at its ends into contact with the inner surface of the case 1 and then the respective external magnetic members 55 such that the core 51 is magnetically coupled to the external magnetic members 55.

The other respects of this embodiment are similar to the corresponding ones of the first embodiment, etc. Hence, the same reference numerals are given to similar structural portions and their further description will be omitted.

The fourth embodiment is in other respects similar in structure to the first embodiment, etc. Thus, the same reference numerals are given to similar components and their further description will be omitted.

Briefly, the radio wave receiver 10 of this embodiment will be fabricated as follows: The pair of opposite external arcuate magnetic members 55 are each disposed in position within the respective one of the pair of cavities 21 provided along the inner periphery of the ceramic case 1.

Then, the reinforcing material 56 is applied into the respective remaining spaces of the cavities 21 in the case 1 where the external magnetic members 55 are disposed. Then, the antenna structure 50 is placed into the case 1 such that the core 53 is brought at both ends into contact with the inner surface of the case 1 and then the corresponding inner surfaces of the external magnetic members 55 in the respective cavities 21 provided in the case 1, thereby causing the core 53 to be magnetically coupled to the external magnetic members 55.

In operation, in the reception of the standard waves, the magnetic field components of the waves enter the core 51 of the antenna structure 50 through the glass cover (not shown) and the dial 11. The magnetic flux is collected by the external magnetic members 55 embedded within the case 1 and then enters the antenna structure 50 at one end 53 of the core 51 magnetically coupled to the associated external magnetic member 55.

The magnetic flux entering the antenna structure 50 then passes to the other end 53 of the core 51. At this time, an AC current is induced through the coil 52 wound around the core 51, thereby generating an AC voltage across the coil 52, which is then sent as an analog signal to a reception circuit (not shown).

The reception circuit amplifies, demodulates and decodes the received signal, thereby acquiring corresponding digital time data. The wristwatch adjusts the current time as required based on the acquired time data.

As described above, according to this embodiment of the wristwatch, the ends 53 of the core 51 are connected to the respective external magnetic members 55, thereby increasing the length of the core 51 and its surface area substantially. Thus, even when the length of the core 51 is reduced, the magnetic flux is collected efficiently, thereby generating enough electromotive force across the coil 52.

Thus, the antenna structure 50, the radio wave receiver including the antenna structure, and the wristwatch including the receiver are reduced in size, and increased greatly in reception sensitivity.

Since in this embodiment the pair of external magnetic members 55 have a trapezoidal section whose width increases axially outward, it can capture magnetic flux more efficiently than if the external magnetic members 55 have a same width as the core.

Further, each external magnetic member 55 is embedded within the respective cavity 21 in the case 1 and fixed with the reinforcing material 56 filling the remaining space in the cavity 21 where the external magnetic member 55 is disposed, thereby preventing a decrease in the strength of the case 1.

While in this embodiment the rod-like core 51 is illustrated as being used, it may be replaced with a core in the form of U such as shown in FIG. 4, which involves the first embodiment. Alternatively, it may be replaced with a core in the form of Y such as shown in FIG. 7, which involves the second embodiment.

In addition, a pair of core subsupports such as shown in FIG. 8, which involves the third embodiment, may be provided between each end of the core 51 and the corresponding external magnetic member 55 to magnetically couple these elements therethrough.

Fifth Embodiment

Figure 13:
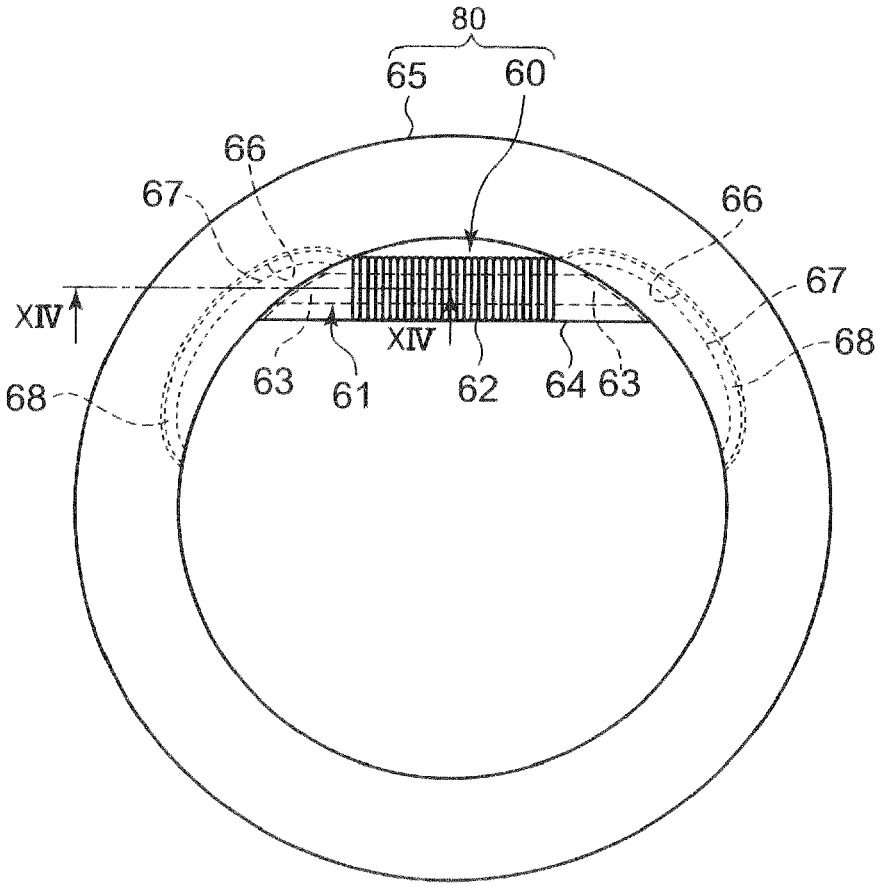
FIG. 13 is a front view of an essential portion of a fifth embodiment in which the antenna structure is received within the case.
Figure 14:
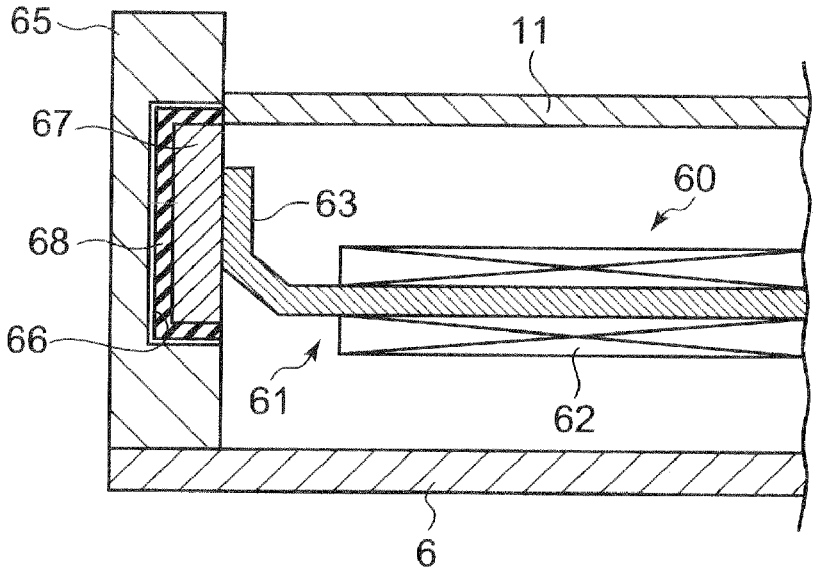
FIG. 14 is a cross-sectional view taken along a line XIV-XIV of FIG. 13.

Referring to FIGS. 13 and 14, the fifth embodiment of the radio wave receiver according to the present invention will be described. The fifth embodiment is different from the first-fourth embodiments with respect to the structure of the case. Thus, especially, those respects of this embodiment different from those of the first-fourth embodiments will be described below.

FIG. 13 is a plan view of the fifth embodiment of the radio wave receiver according to the present invention, showing the antenna structure encased within the case. FIG. 14 is a cross-sectional view taken along a line XIV-XIV in FIG. 13, showing contacting relationship between the antenna structure 60 and the case 65.

In the present embodiment, the radio wave receiver is embodied as a radio-controlled wristwatch whose case 65 is made of a metal such as titanium or stainless steel. The core 61 of the antenna structure 60 provided in the radio wave receiver is made of a plurality of thin layers of amorphous alloy (not shown), as in the first-fourth embodiments.

A pair of opposite external arcuate magnetic members 67 are each embedded within a respective one of a pair of cavities 66 provided along the inner periphery of the case 65, as in the first embodiment.

An insulating material 68, which may include an insulating resin, is provided between each cavity 66 in the metal case 65 and the corresponding external magnetic member 67 received in the cavity 66.

When the antenna structure 60 is placed together with the housing within the case 65, the core 61 is bent in the form of L at each end (and hence in the form of U as a whole) by the inner surface of the case 65 and then the respective external magnetic members 67 such that the core 61 is magnetically coupled to the external magnetic members 67, as shown in FIG. 14. In this embodiment, the radio wave receiver 80 is composed of the antenna structure 60 with the core 61 and the case 65 containing the pair of external magnetic members 67.

The fifth embodiment is in other respects similar in structure to the first and second embodiments. Thus, the same reference numerals are given to similar components and their further description will be omitted.

Briefly, the radio wave receiver 80 of this embodiment will be fabricated as follows: The insulating material 68 is disposed within the respective one of the pair of opposite cavities 66 provided along the inner periphery of the case 65 so as to cover the inner surface of the cavity 66.

Then, each external magnetic member 67 is placed in position through the insulating material 68 into the cavity 66 from the side of the insulating material 68. Then, the antenna structure 60 is disposed within the case 65 such that the antenna core 61 is brought at each end 63 into contact with the inner surface of the case and then the corresponding external magnetic member 67, thereby causing the core 61 to be magnetically coupled to the same.

In operation, in the reception of the standard waves, the magnetic field components of the waves enter the core 61 of the antenna structure 60 through the glass cover (not shown) and the dial 11. The magnetic flux is collected by the external magnetic members 67 embedded within the case 65 and then enters the antenna structure 60 at one end 63 of the core 61 magnetically coupled to that external magnetic members 67.

The magnetic flux entering the antenna structure 60 then passes to the other end 63 of the core 61. At this time, an AC current is induced through the coil 62 wound around the core 61, thereby generating an AC voltage across the coil 62, which is then sent as an analog signal to a reception circuit (not shown).

The reception circuit amplifies, demodulates and decodes the received signal, thereby acquiring corresponding digital time data. The wristwatch adjusts the current time as required based on the acquired time data.

As described above, according to this embodiment, since this wristwatch includes the metal case 65, it is excellent as such from the standpoint of designability and a sense of high quality. Since the insulating material 68 is disposed within the respective cavity 66 provided along the inner periphery of the metal case 65, the corresponding external magnetic member 67 is prevented from being brought into contact with the case 65.

Thus, like the first-fourth embodiments, the ends 63 of the core 61 are connected to the respective corresponding external magnetic members 67, thereby increasing the length of the core 61 and its surface area substantially. Thus, even when the length of the core 61 is reduced, the magnetic flux is collected efficiently. Thus, the antenna structure 60, the radio wave receiver including the antenna structure, and the wristwatch including the receiver are reduced in size, and increased greatly in reception sensitivity.

While in this embodiment the U-like core 61 is illustrated as used, it may be replaced with a core in the form of Y such as shown in FIG. 7, which involves the second embodiment. Alternatively, it may be replaced by a rod-like core with a trapezoidal cross-sectional external magnetic member at each end such as shown in FIG. 11, which involves the fourth embodiment.

In addition, a pair of core subsupports such as shown in FIG. 8, which involves the third embodiment, may be provided between each end 63 of the core 61 and the corresponding external magnetic member 67 to magnetically couple these elements therethrough.

Figure 15:
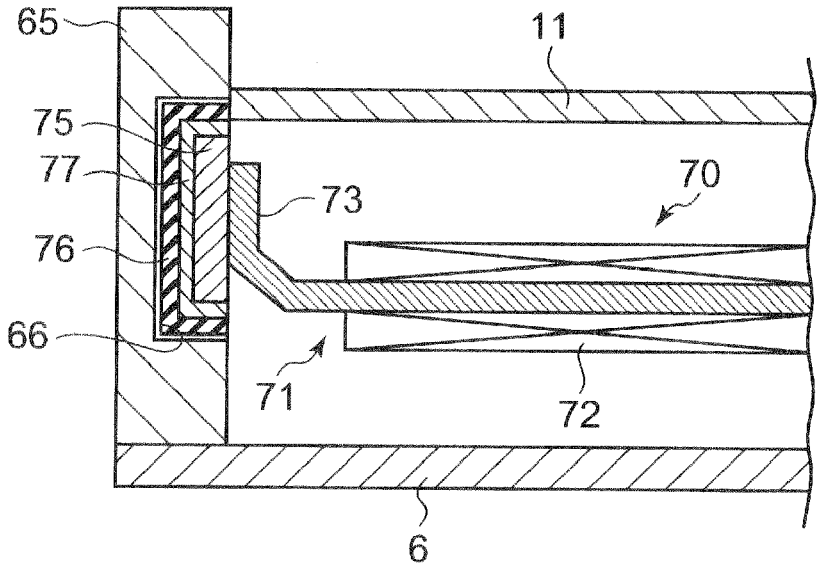
FIG. 15 shows a modification of the fifth embodiment.

As shown in FIG. 15, each second magnetic member 77 may be provided between the insulating member 76 and the corresponding first external magnetic member 75 within the case 65 to suppress generation of eddy currents due to leaking magnetic flux acting on the metal case 65. Thus, preferably, the second outer magnetic member 77 has a relative permeability of 10-100 H/m and more preferably, 20-100 H/m with a low magnetic loss and with as low conductivity as possible.

Provision of each second magnetic member 77 between the corresponding insulating member 76 and external magnetic member 75 serves to prevent generation of leaking flux, eddy currents on the metal case 65 and eddy current loss, thereby improving the reception sensitivity further.

Figure 16:
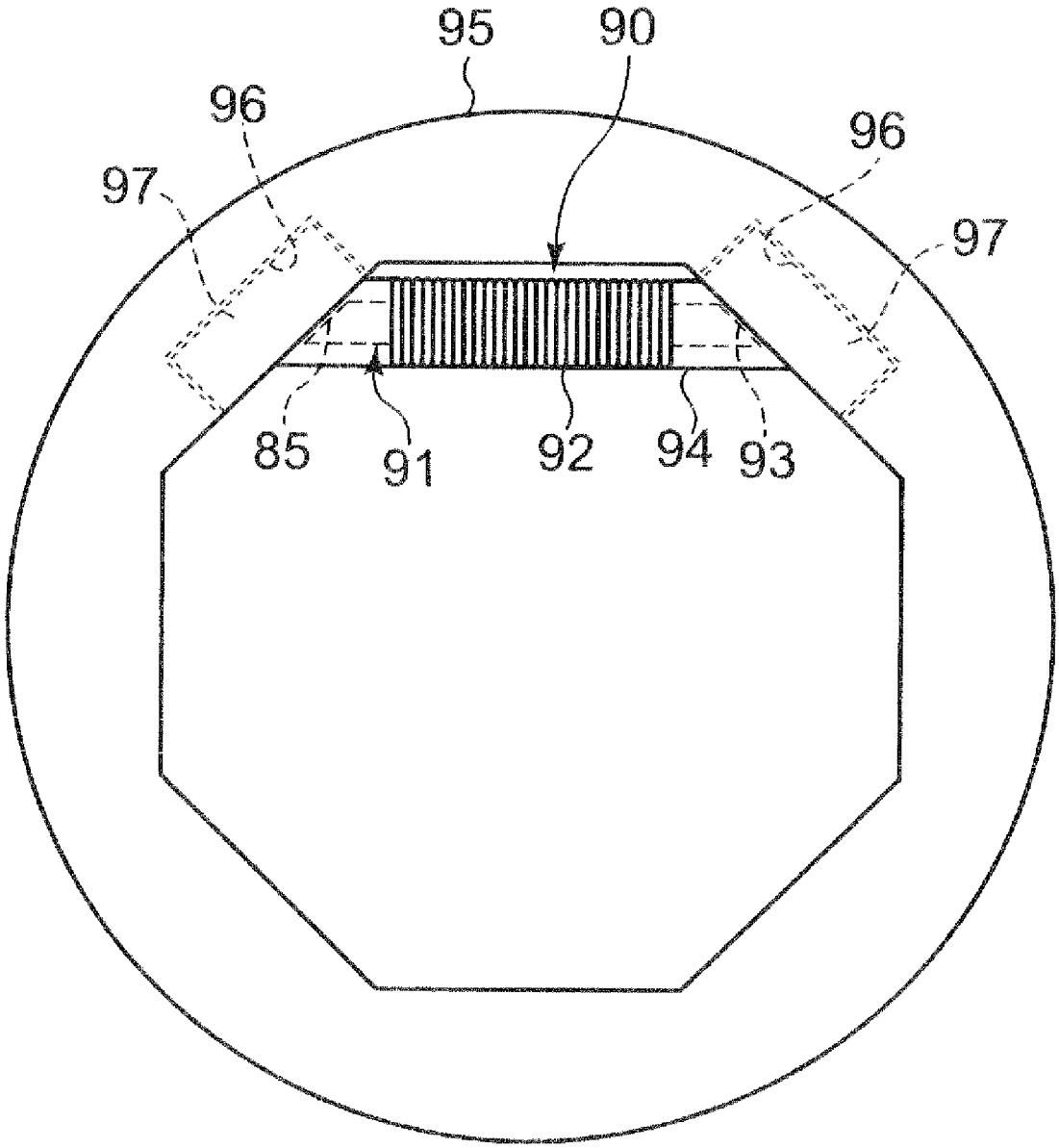
FIG. 16 is a front view of a modification of the case.

While in the above embodiments the inner periphery of the case is illustrated as being circular, it may have a polygonal inner periphery as shown in FIG. 16.

In this case, a pair of opposite rod-like external magnetic members 97 are each received adjacent to a respective end of a core 93 within a corresponding one of a pair of cavities 96 each provided along an associated one of sides of the polygonal inner periphery of the case 95 such that the core 91 is coupled magnetically at its ends to the adjacent external magnetic members 97, thereby guiding much magnetic flux into a coil 92 through the external magnetic members 97.

It is noted that the positions of the cavities 96 and the shape of the external magnetic members 97 are not specially limited, and that the external magnetic members 97 and corresponding cavities 96 may extend longer.

While in the embodiments the antenna core is illustrated as being made of the plurality of thin layers of amorphous alloy or others, it may be made of a single piece, for example, of ferrite. In this case, when the core cannot be put in sufficiently close contact with the external magnetic members, core supports such as shown by 45 in the third embodiment may be used to connect the core and the external magnetic members.

While in the above embodiments the antenna structure is illustrated as received within the case, the case is not an essential component. The present invention is applicable to an antenna structure which is not encased within the case.

The synthetic resin which composes the housing and others may be, for example, epoxy or phenolic resin.

While in the above embodiments the radio wave receiver is illustrated in the form of a radio-controlled wristwatch, the present invention is applicable to any devices which receive radio waves using an antenna structure. For example, the present invention is applicable to fixed type radio-controlled watches or clocks, and small radios and mobile phones.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A radio wave receiver comprising:

an antenna structure including a rod-like core of a magnetic material and a coil wound around the core;

a case encasing the antenna structure therein; and a pair of external magnetic members each made of a magnetic material of a permeability similar to that of the core, each external magnetic member being received in a respective one of a pair of cavities provided within the case, and each cavity being adjacent to a respective end of the core such that the core is magnetically coupled to the respective external magnetic members;

wherein each of the pair of external magnetic members is disposed in the respective one of the pair of cavities axially outward of each end of the antenna coil so as to extend away from near outside the respective end of the core beyond a first line parallel to an axis of the core and passing through a center of the case, but beyond the first line each of the pair of external magnetic members does not further extend toward the other beyond a respective one of two second lines that are orthogonal to the first line and pass through two points, respectively, on an inner periphery of the case where the first line intersects the case.

2. The radio wave receiver of claim 1, wherein the case is made of an insulator.

3. The radio wave receiver of claim 2, further comprising a reinforced material filling a remaining space in each cavity to fix the external magnetic member disposed therein to the case.

4. The radio wave receiver of claim 1, wherein the case is made of a metal material; and wherein the radio wave receiver further comprises an insulator disposed between each of the cavities and the external magnetic member disposed in the cavity.

5. The radio wave receiver of claim 4, further comprising a second magnetic member of a relative permeability of approximately 10-100 H/m with a low magnetic loss disposed in each of the cavities between the insulator and the external magnetic member.

6. The radio wave receiver of claim 1, wherein each external magnetic member is made of an amorphous alloy or a plurality of permalloy film layers.

7. The radio wave receiver of claim 1, further comprising a magnetic support provided between each of the pair of external magnetic members and the respective end of the core for magnetically coupling the core to the external magnetic member.

8. A radio wave receiver comprising:

an antenna structure including a rod-like core of a magnetic material and a coil wound around the core;

a case encasing the antenna structure therein; and a pair of external magnetic members each made of a magnetic material of a permeability similar to that of the core, each external magnetic member being received in a respective one of a pair of cavities provided within the case, and each cavity being adjacent to a respective end of the core such that the core is magnetically coupled to the respective external magnetic members;

wherein each of the pair of external magnetic members is disposed in the respective one of the pair of cavities axially outward of each end of the antenna coil so as to extend away from near outside the respective end of the core, but does not extend beyond a line parallel to an axis of the core and passing through a center of the case.

9. The radio wave receiver of claim 8, wherein the case is made of an insulator.

10. The radio wave receiver of claim 9, further comprising a reinforced material filling a remaining space in each cavity to fix the external magnetic member disposed therein to the case.

11. The radio wave receiver of claim 8, wherein the case is made of a metal material; and wherein the radio wave receiver further comprises an insulator disposed between each of the cavities and the external magnetic member disposed in the cavity.

12. The radio wave receiver of claim 11, further comprising a second magnetic member of a relative permeability of approximately 10-100 H/m with a low magnetic loss disposed in each of the cavities between the insulator and the external magnetic member.

13. The radio wave receiver of claim 8, wherein each external magnetic member is made of an amorphous alloy or a plurality of permalloy film layers.

14. The radio wave receiver of claim 8, further comprising a magnetic support provided between each of the pair of external magnetic members and the respective end of the core for magnetically coupling the core to the external magnetic member.

* * * * *